US008117953B2

(12) United States Patent
Aigner

(10) Patent No.: US 8,117,953 B2
(45) Date of Patent: Feb. 21, 2012

(54) STOP RULE WITH HOLD-DOWN DEVICE FOR CIRCULAR SAW BENCHES

(76) Inventor: Georg Aigner, Reisbach (DE)

( * ) Notice: Subject to any disclaimer, the term of this patent is extended or adjusted under 35 U.S.C. 154(b) by 324 days.

(21) Appl. No.: 12/444,609

(22) PCT Filed: Apr. 29, 2008

(86) PCT No.: PCT/EP2008/055227
§ 371 (c)(1),
(2), (4) Date: May 1, 2009

(87) PCT Pub. No.: WO2008/138745
PCT Pub. Date: Nov. 20, 2008

(65) Prior Publication Data

US 2009/0272241 A1 Nov. 5, 2009

(30) Foreign Application Priority Data

May 10, 2007 (DE) ..... 10 2007 021 973
Aug. 7, 2007 (DE) ..... 10 2007 037 227

(51) Int. Cl.
*B27B 27/02* (2006.01)

(52) U.S. Cl. ..... 83/447; 83/450; 144/250.12

(58) Field of Classification Search ..... 83/437.2, 83/438–440, 446, 447, 450, 409, 468.1, 468.6, 83/468.8, 477.2, 432, 435.14, 435.19, 440.2, 83/875, 436.2; 144/253.1, 253.5, 250.15, 144/250.2
See application file for complete search history.

(56) References Cited

U.S. PATENT DOCUMENTS

| | | | | | |
|---|---|---|---|---|---|
| 222,574 | A | * | 12/1879 | Constant | 83/438 |
| 272,734 | A | * | 2/1883 | McDonald | 83/438 |
| 287,124 | A | * | 10/1883 | Hamlet | 83/438 |
| 326,454 | A | * | 9/1885 | Rawlings | 83/438 |
| 904,342 | A | * | 11/1908 | Loehr | 83/438 |
| 954,192 | A | * | 4/1910 | Lambert | 83/438 |
| 1,535,596 | A | * | 4/1925 | French | 83/875 |
| 1,544,290 | A | * | 6/1925 | Walstad | 83/438 |
| 1,799,738 | A | * | 4/1931 | Dirschauer et al. | 83/446 |
| 1,957,711 | A | * | 5/1934 | Heyman | 83/367 |
| 2,458,846 | A | * | 1/1949 | Gilmore | 83/438 |
| 2,560,996 | A | * | 7/1951 | Stone | 83/438 |
| 2,735,466 | A | * | 2/1956 | Krstinich | 99/555 |
| 4,294,151 | A | * | 10/1981 | Lemus | 83/477.2 |
| 4,469,318 | A | * | 9/1984 | Slavic | 269/91 |
| 4,481,846 | A | * | 11/1984 | Goodell | 83/438 |

(Continued)

FOREIGN PATENT DOCUMENTS

DE 19515829 11/1996

(Continued)

*Primary Examiner* — Laura M. Lee
(74) *Attorney, Agent, or Firm* — Themis Law

(57) ABSTRACT

A stop rule for circular saw benches includes a profiled hollow body extending longitudinally with a substantially right-angled cross section, on which means are located for the attachment thereof to a table. One side of the profiled hollow body is designed as a guide member with a coplanar extension extending therefrom, which has a guide rule on the front edge thereof for low workpieces. Such guide rule extends vertically at right angles from the table, on which the guide member lies when the stop rule is in a horizontal position. The extension protruding sideways has a horizontal contact surface in the horizontal position of the stop rule, on which surface a vertically adjustable hold-down device for low work pieces is connected.

10 Claims, 4 Drawing Sheets

U.S. PATENT DOCUMENTS

| | | | | |
|---|---|---|---|---|
| 4,593,590 | A * | 6/1986 | Gray | 83/438 |
| 4,693,158 | A * | 9/1987 | Price | 83/468 |
| 4,713,993 | A * | 12/1987 | Litowitz | 83/34 |
| 4,817,482 | A * | 4/1989 | Dunaway et al. | 83/438 |
| 5,038,486 | A * | 8/1991 | Ducate, Sr. | 33/430 |
| 5,148,846 | A * | 9/1992 | Van Gelder | 144/250.13 |
| 6,029,721 | A * | 2/2000 | O'Banion | 144/287 |
| 6,164,176 | A | 12/2000 | Larsson | |
| 6,557,601 | B1 * | 5/2003 | Taylor | 144/253.1 |
| 6,619,347 | B2 * | 9/2003 | Jukoff et al. | 144/253.6 |
| 6,880,442 | B2 * | 4/2005 | Duginske | 83/468.7 |
| 7,127,976 | B1 * | 10/2006 | Fitzsimmons | 83/435.11 |
| 2002/0108480 | A1 * | 8/2002 | Hewitt et al. | 83/446 |
| 2008/0092707 | A1 | 4/2008 | Aigner | |

FOREIGN PATENT DOCUMENTS

| | | |
|---|---|---|
| DE | 102005024111 | 8/2006 |

* cited by examiner

STOP RULE WITH HOLD-DOWN DEVICE FOR CIRCULAR SAW BENCHES

FIELD OF THE INVENTION

The present invention relates to a stop rule having a holddown for table saws. More particularly, the present invention relates to a stop rule for table saws, which includes a hollow profile that extends in a longitudinal direction and that has a guidance limb extendable from one side.

BACKGROUND OF THE INVENTION

Applicant's DE-B 10 2005 024 111 (US 2008/0092707) discloses a stop rule for table saws that can be used in both an upright and a laid-down position, so that, in addition to tall workpieces, low and narrow workpieces can also be processed. In the latter case, the risk exists that the workpieces may lose their contact with the saw table in the region of the saw blade and deviate upward, which can result not only in inaccuracy and improper processing, but also in accidents.

SUMMARY OF THE INVENTION

It is the object of the invention to provide a remedy to the above defined problem and to configure a stop rule so that narrow and low workpieces can be held at their free ends so that they cannot move away from the saw table during processing.

In order to achieve this object, according to the invention a vertically displaceable holddown, which is fastened on a horizontal support surface of the lateral extension of the stop rule when in the laid-down position, is attached to the stop rule.

The holddown is preferably made up of a profiled bar having a limb that protrudes vertically upward, which limb is fastened via a scissor linkage on the horizontal support surface of the extension or on a baseplate of the holddown, which baseplate can in turn be fastened removably on the support surface.

The essential advantage of the invention is the fact that the stop rule is equipped with a holddown that, principally thanks to the scissor linkage, is of such compact construction that it can be accommodated on the relatively narrow support surface of the stop rule and also requires little installation space vertically. The holddown can be an integral constituent of the stop rule or can be fastened via its baseplate removably on the rule's support surface. The scissor linkage is braced against the support surface and baseplate via elastic return means. The return means are preferably made of leaf springs, which likewise require little space.

Immobilization of the scissor linkage in its compression position resting on the workpiece is achieved by a catch lever that extends parallel to the vertical limb of the profiled bar and is fixedly connected to the articulation axis of the scissor linkage, the articulation axis having a thread that clamps the two levers of the scissor linkage against one another in the immobilized position.

BRIEF DESCRIPTION OF THE DRAWINGS

Further features and advantages of the invention are evident from the description below of exemplifying embodiments that are depicted in the drawings, in which.

DETAILED DESCRIPTION OF A PREFERRED EMBODIMENT

Figure 1:
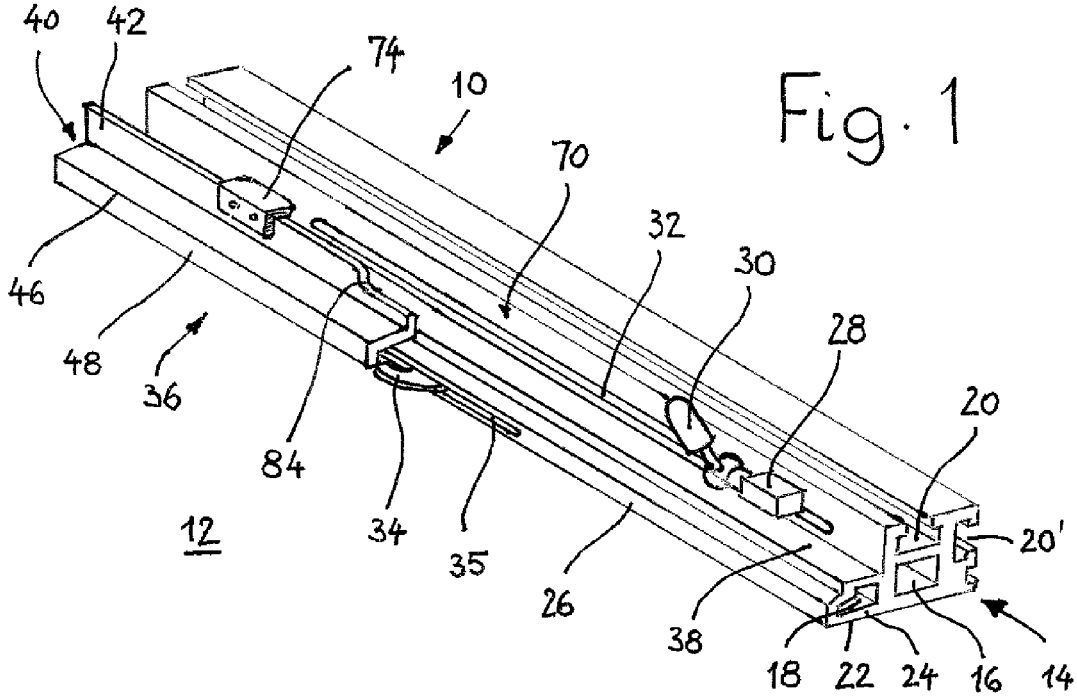
FIG. 1 is a perspective view of a stop rule having an integrated holddown, according to the invention.

FIG. 1 shows a stop rule 10 that is embodied similarly to the stop rule in accordance with DE-B 10 2005 024 111 (US 2008/0092707) and that can be fastened on a saw table 12 of a table saw, where it serves for the guidance of bar-shaped workpieces.

Stop rule 10 is made up of a hollow profile 14 that extends in a longitudinal direction and has a substantially rectangular or square cross section with a central cavity 16 and a smaller lateral cavity 18. Embodied on hollow profile 14, in known fashion, are profile grooves 20, 20' that serve for the engagement of fastening means (not further depicted) on saw table 12.

One side of hollow profile 14 is embodied as a guidance limb 22 having an extension 24, protruding in coplanar fashion, that comprises at its front edge a guidance rule 26 for low workpieces. Small cavity 18 is embodied in extension 24 that protrudes laterally from hollow profile 14. With stop rule 10 in the laid-down position shown in FIG. 1, guidance limb 22 rests on saw table 12 so that guidance rule 26 protrudes at right angles upward from saw table 12.

Supported in larger cavity 16, having a rectangular or square cross section, is a slide (not shown) that can be shifted, by means of a slider 28 having a handle 30, in the longitudinal direction of stop rule 10. Further details thereof are presented and explained in DE-B 10 2005 024 111 (US 2008/0092707). By way of slider 28, which engages into a passthrough groove 32, a follower finger 34 can be shifted in a longitudinal groove 35 of guidance rule 26 in order to advance a low workpiece on saw table 12 when stop rule 10 is in the laid-down position.

In the exemplifying embodiment of FIGS. 1 to 4, stop rule 10 is equipped with an integrated holddown 36 that is fastened on horizontal support surface 38 of laterally protruding extension 24. Holddown 36 is made up of an approximately Z-shaped profiled bar 40 that is associated with the front (in the advance direction) part of stop rule 10. Profiled bar 40 has a vertically upwardly protruding limb 42 that is fastened via a scissor linkage 44 on horizontal support surface 38 of extension 24. Projecting from the lower edge of vertical limb 42 is an angled bar 46 having a downwardly protruding contact bar 48, as is evident from FIG. 2. Contact bar 48 is arranged at a very small distance in front of guidance rule 26, so that even very narrow workpieces can be grasped and processed.

Figure 2:
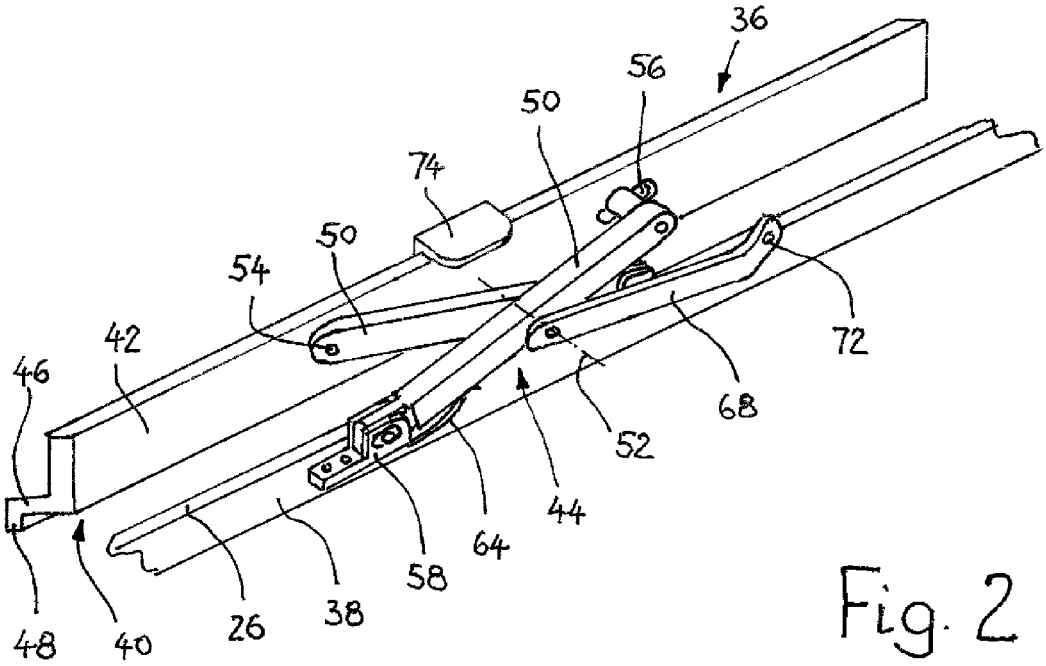
FIG. 2 is a perspective rear view of the holddown at an enlarged scale.

Scissor linkage 44 is assembled from two levers 50 that are interconnected via an articulation axis 52 indicated schematically in FIG. 2. The upwardly facing ends of the two levers 50 are articulated onto vertical limb 42 of holddown 36. A left (in FIGS. 2 and 3) articulation point 54 serves this purpose for the one lever 50, while an elongated hole 56 is provided for the other lever 50 on the right side.

Figure 3:
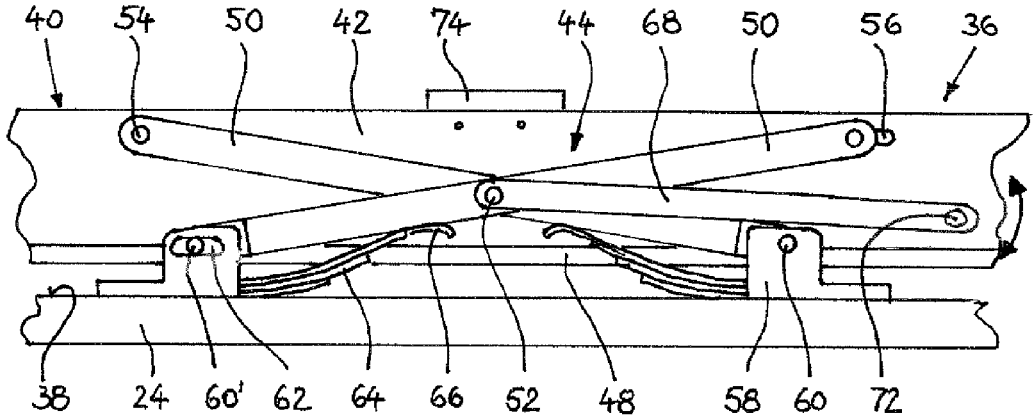
FIG. 3 is a rear view axonometrically depicting the holddown.

Because scissor linkage 44, as a result of the above-described articulation points on profiled bar 40 visible especially in FIG. 3, does not project above the upper edge of vertical limb 42, the overall vertical height is also sufficiently limited that stop rule 10 can be used without restrictions even in its upright position, in which guidance limb 22 stands vertically on saw table 12.

The lower ends of the two levers 50 of scissor linkage 44 are each braced in a bearing bracket 58 that is fastened on horizontal support surface 38. As is apparent from FIG. 3, one of the two levers 50 is in turn supported in pivotably movable fashion in the associated bearing bracket 58 via a fixed articulation pin 60, whereas the other lever 50 is supported with its articulation pin 60' shiftably in an elongated hole 62.

FIG. 3 further shows that a leaf spring packet 64 is fastened in each bearing bracket 58, the free end 66 of said packet engaging on the underside of the associated lever 50 of scissor linkage 44.

A catch lever 68, which extends parallel to vertical limb 42 of profiled bar 40, is provided in order to immobilize scissor linkage 44 in the compression position of holddown 36 resting on the workpiece. One end of catch lever 68 is fixedly connected to articulation axis 52 of scissor linkage 44, said articulation axis 52 having a thread (not further depicted), known per se, that in the immobilizing position clamps the two levers 50 of scissor linkage 44 against one another.

Figure 4:
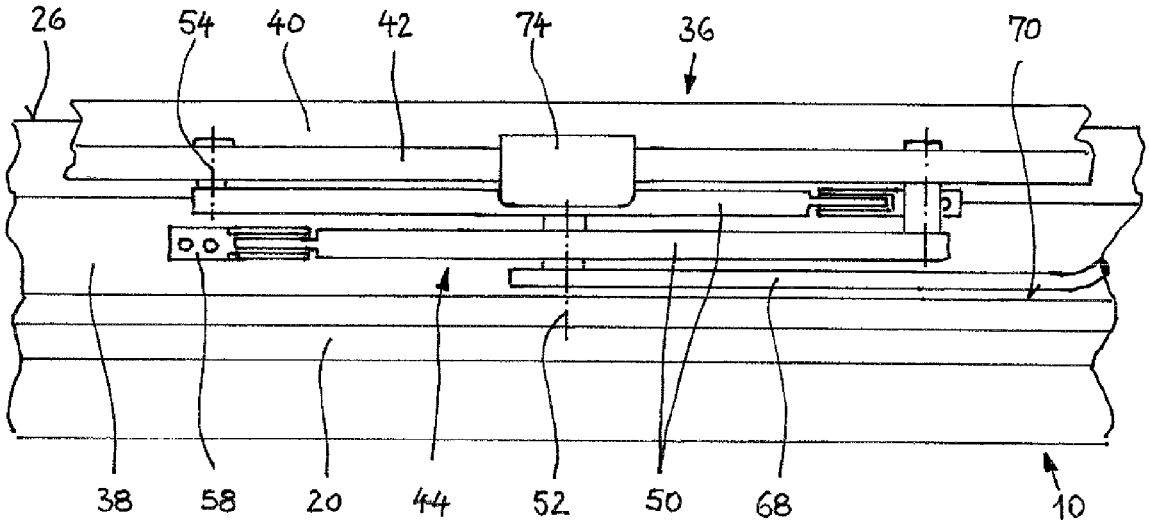
FIG. 4 is a plan view of the holddown.

As FIG. 4 shows, the free end of catch lever 68 is angled with respect to vertical limb 42 so that it can be grasped manually, in the narrow space between vertical limb 42 and the oppositely located vertical wall 70 of hollow profile 14 (see FIG. 1), in order to pivot catch lever 68 out of its disengaged position into the immobilized position and vice versa. The angled free end of catch lever 68 is equipped with a grip recess 72 (see FIG. 2).

Fastened on the upper edge of vertical limb 42 of profiled bar 40 is a pressure plate 74, with which profiled bar 50 can be displaced downward by thumb pressure, against the spring force, in order to press contact bar 48 against the workpiece. Holddown 36 is locked in this position by actuating catch lever 68. During sawing, the workpiece is advanced to the saw blade via follower finger 34, which passes through under the lower edge of contact bar 48. To release holddown 36, catch lever 68 is pivoted back into its disengaged position in which leaf springs 64 then, via scissor linkage 44, raise profiled bar 40 into its initial position.

Figure 5:
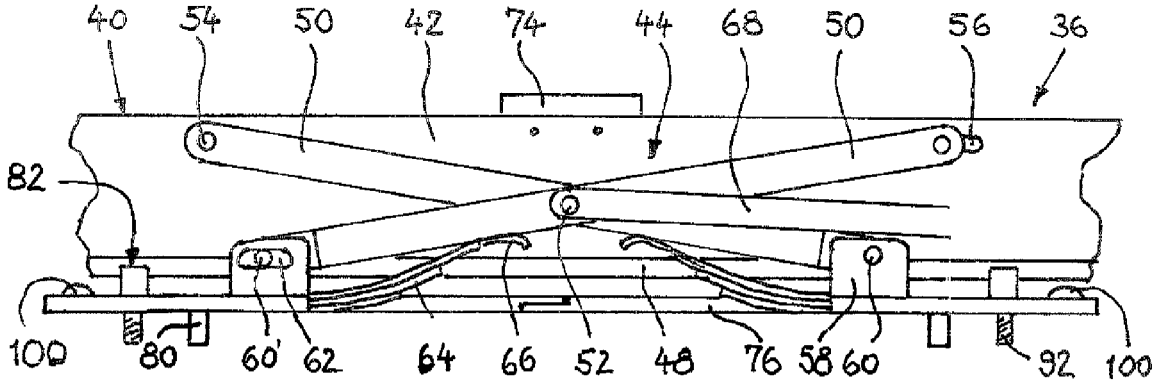
FIG. 5 shows a variant of FIG. 3.
Figure 6:
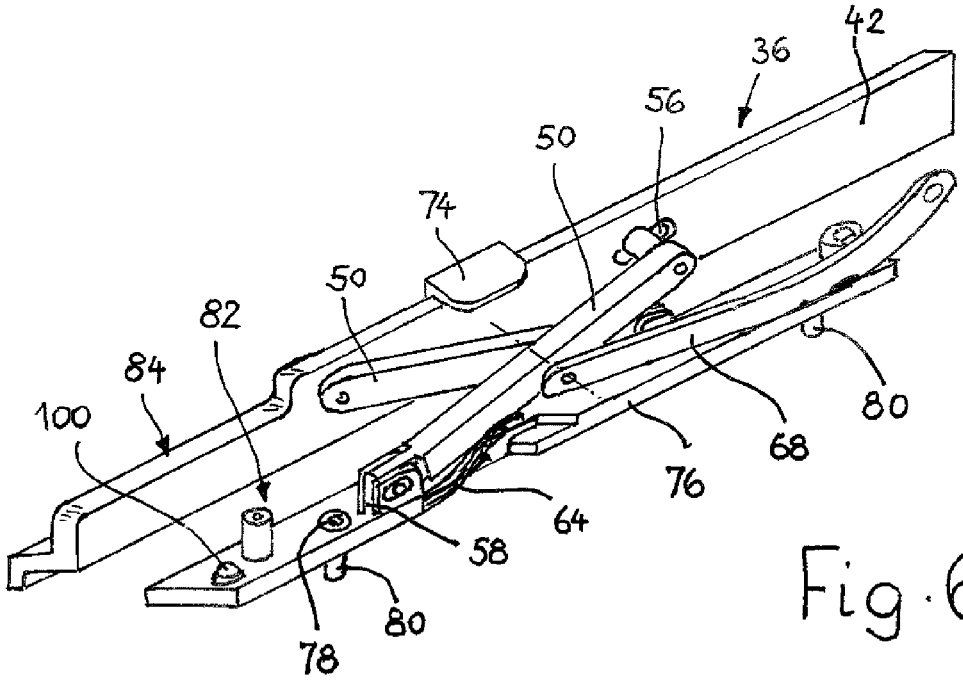
FIG. 6 shows the removable holddown of FIG. 5.
Figure 7:
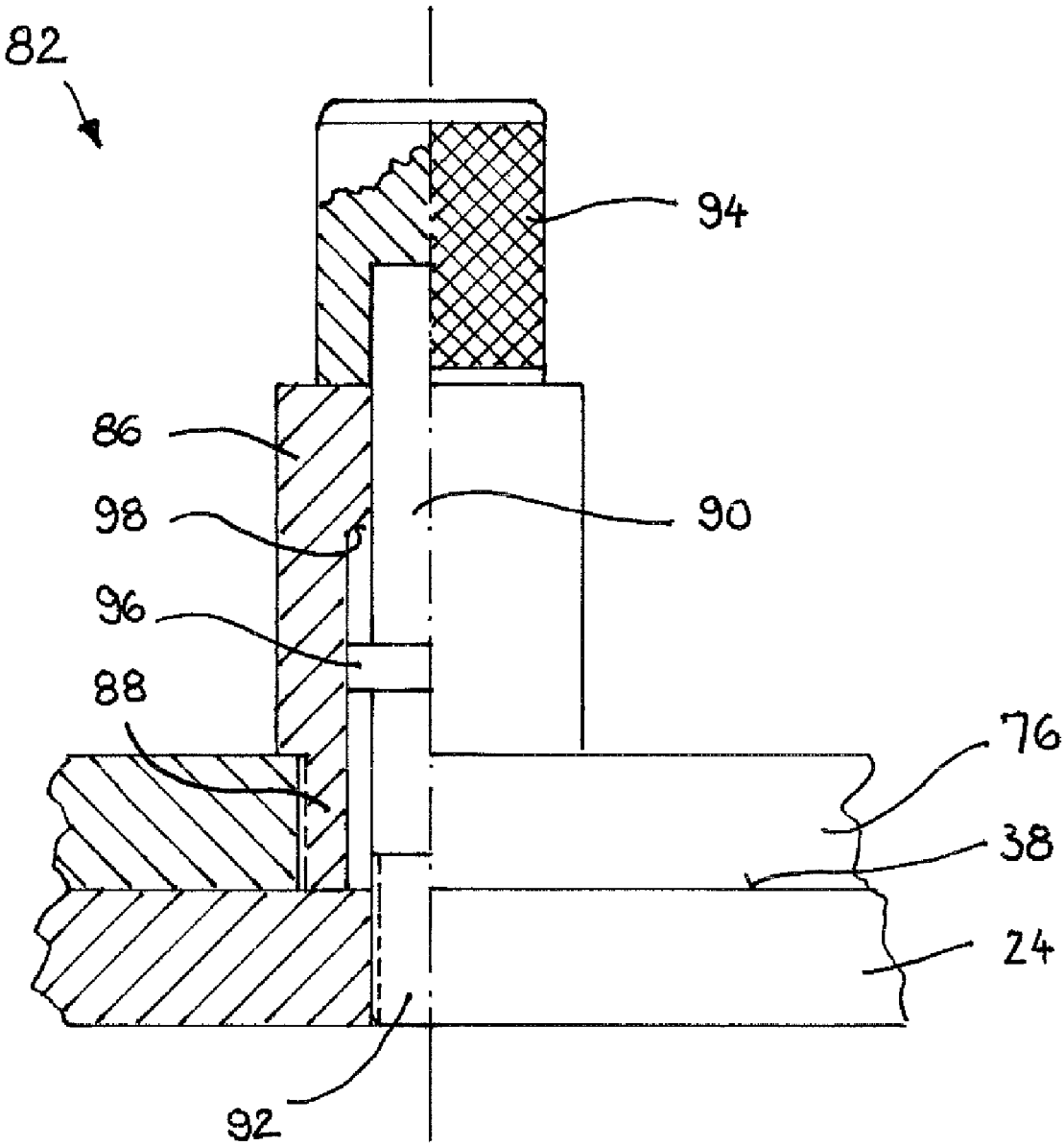
FIG. 7 is a partly sectioned depiction of a securing screw at enlarged scale.

In the variant shown in FIGS. 5 and 6, holddown 36 is fastened removably on support surface 38 of stop rule 10 so that it can be removed quickly when the table saw blade is set obliquely. Holddown 36 has for this purpose a horizontal baseplate 76 from which the two bearing blocks 58, which are embodied integrally therewith, protrude upward. The two leaf spring packets 64 are each fastened in a cutout of baseplate 76 beneath the associated bearing block 58, specifically by means of a hex socket screw 78 whose threaded portion is screwed into a centering pin 80. Two lossproof securing screws 82, one of which is depicted in FIG. 7, serve to fasten baseplate 76, and thus holddown 36, on support surface 38. It is evident here that securing screw 82 is made up of a sleeve 86 that is screwed, with a threaded shaft 88, into a threaded orifice of baseplate 76. Arranged in vertically movable fashion in sleeve 86 is a flanged stud 90 whose threaded end 92 is screwed into a threaded orifice of extension 24 of guidance limb 22 when holddown 36 is in the installed position. The upper end of flanged stud 90 is fastened in a knurled nut 94, e.g. adhesively bonded therein. When securing screw 82 is loosened, it can be raised only until its flange 96 comes to a stop against an internal shoulder 98 of sleeve 86.

With holddown 36 in the installed state, the two centering pins 80 engage into corresponding centering orifices of support surface 38.

FIGS. 5 and 6 show that two resilient end stop elements 100 made of polyamide, which prevent catch lever 68 from impacting sharply onto baseplate 76 or onto support surface 38, are fastened on baseplate 76.

Lastly, it is indicated in FIGS. 1 and 6 that a step 84 is machined into one part of the upper edge of vertical limb 42 of profiled bar 40; when stop rule 10 is in the upright position, handle 30 can be introduced into this step if follower finger 34 needs to be shifted as far forward as possible.

The invention claimed is:

1. A stop rule for a table saw comprising:

a hollow profile of substantially rectangular cross section extending in a longitudinal direction, the hollow profile being configured to be fastened on a saw table, wherein one side of the hollow profile comprises a guidance limb having an extension protruding in coplanar fashion laterally therefrom, the extension having at a front edge a guidance rule for thinner workpieces, such that, when the stop rule is in a laid-down position in which the guidance limb rests on the saw table, the guidance rule protrudes at a right angle upwardly from the saw table, wherein the laterally protruding extension has a support surface that is parallel to the saw table when the stop rule is in the laid-down position, an upwardly displaceable holddown for the thinner workpieces being fastened on the support surface, wherein the holddown comprises a profiled bar having an upwardly protruding limb that is fastened via a scissor linkage on a baseplate or on the support surface of the extension, and wherein a catch lever is provided for immobilization of the scissor linkage when the holddown is in a compression position resting on the workpiece, the catch lever being substantially parallel to the upwardly protruding limb of the profiled bar and being fixedly connected to an articulation axis of the scissor linkage, such to cause two levers of the scissor linkage to clamp against one another in an immobilized position.

2. The stop rule according to claim 1, wherein the baseplate is configured to be fastened removably on the support surface.

3. The stop rule according to claim 2, further comprising at least one securing screw coupled to the baseplate of the holddown for fastening therewith, the at least one securing screw being engageable into a threaded orifice of the extension of the guidance limb.

4. The stop rule according to claim 1, further comprising an angled bar having a downwardly protruding contact bar, the angled bar projecting from a lower edge of the upwardly protruding limb.

5. The stop rule according to claim 1, wherein the scissor linkage is braced via elastic return means against one or more of the baseplate and the support surface.

6. The stop rule according to claim 5, wherein the elastic return means comprise leaf springs.

7. The stop rule according to claim 5, wherein the scissor linkage is braced in two bearing brackets that protrude from the baseplate or the support surface.

8. The stop rule according to claim 7, wherein a leaf spring packet, having a free end that engages one lever of the scissor linkage, is fastened on each bearing bracket.

9. The stop rule according to claim 8, wherein the leaf spring packet is fastened to a lower region of the bearing bracket with a centering pin that projects beyond an underside of the baseplate for engagement into a centering orifice in the support surface.

10. The stop rule according to claim 1, further comprising at least one resilient end stop element for the catch lever that is mounted on the support surface or on the baseplate.

* * * * *